US011021301B2

(12) United States Patent
Cobler

(10) Patent No.: US 11,021,301 B2
(45) **Date of Patent: *Jun. 1, 2021**

(54) DRAWSTRING TRASH BAG

(71) Applicant: Poly-America, L.P., Grand Prairie, TX (US)

(72) Inventor: Brad A. Cobler, Irving, TX (US)

(73) Assignee: Poly-America, L.P., Grand Prairie, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/811,032

(22) Filed: Mar. 6, 2020

(65) Prior Publication Data

US 2020/0247588 A1 Aug. 6, 2020

Related U.S. Application Data

(63) Continuation of application No. 16/269,040, filed on Feb. 6, 2019, now Pat. No. 10,618,698.

(51) Int. Cl.
*B65D 33/28* (2006.01)
*B65F 1/00* (2006.01)

(52) U.S. Cl.
CPC ..... *B65D 33/28* (2013.01); *B65F 1/0006* (2013.01)

(58) Field of Classification Search
CPC ..... B65D 33/28; B65F 1/0006
USPC ..... 383/75
See application file for complete search history.

(56) References Cited

U.S. PATENT DOCUMENTS 3,010,640 A * 11/1961 Kugler ..... B65D 33/28 383/75
3,029,853 A * 4/1962 Piazze ..... B65D 33/28 383/75
3,687,357 A * 8/1972 Hansen ..... B65D 33/28 383/72
3,738,567 A * 6/1973 Ruda ..... B65D 33/28 383/75
4,628,536 A * 12/1986 Herrington ..... B29C 55/06 383/75
4,650,451 A * 3/1987 Herrington ..... B29C 55/06 26/71
4,802,582 A * 2/1989 Johnson ..... B26D 3/14 206/390
5,133,607 A * 7/1992 Bonke ..... B65D 33/28 220/495.11
5,232,118 A * 8/1993 Samuel ..... B65D 33/28 220/495.11
5,265,962 A * 11/1993 Ogawa ..... B65D 33/28 383/71
6,059,458 A * 5/2000 Belias ..... B65D 33/28 220/495.11
6,402,377 B1 * 6/2002 Vo ..... B65D 33/28 383/75

(Continued)

*Primary Examiner* — Peter N Helvey
(74) *Attorney, Agent, or Firm* — Daniel J. Layden; Brandon J. Lee

(57) ABSTRACT

The present invention relates to polymeric bags, particularly polymeric drawstring trash bags. The present invention comprises a trash bag having an elastic drawstring. The elastic drawstring trash bag features an integrated short seal comprising an inner seal, an outer seal, and an intermediate seal. The integrated short seal functions to reduce the upper opening of the drawstring trash bag, while the elastic drawstring utilized with the bag provides a bag that allows the bag to fit snugly on many common trash receptacles.

14 Claims, 4 Drawing Sheets

(56) References Cited

Figure 1:
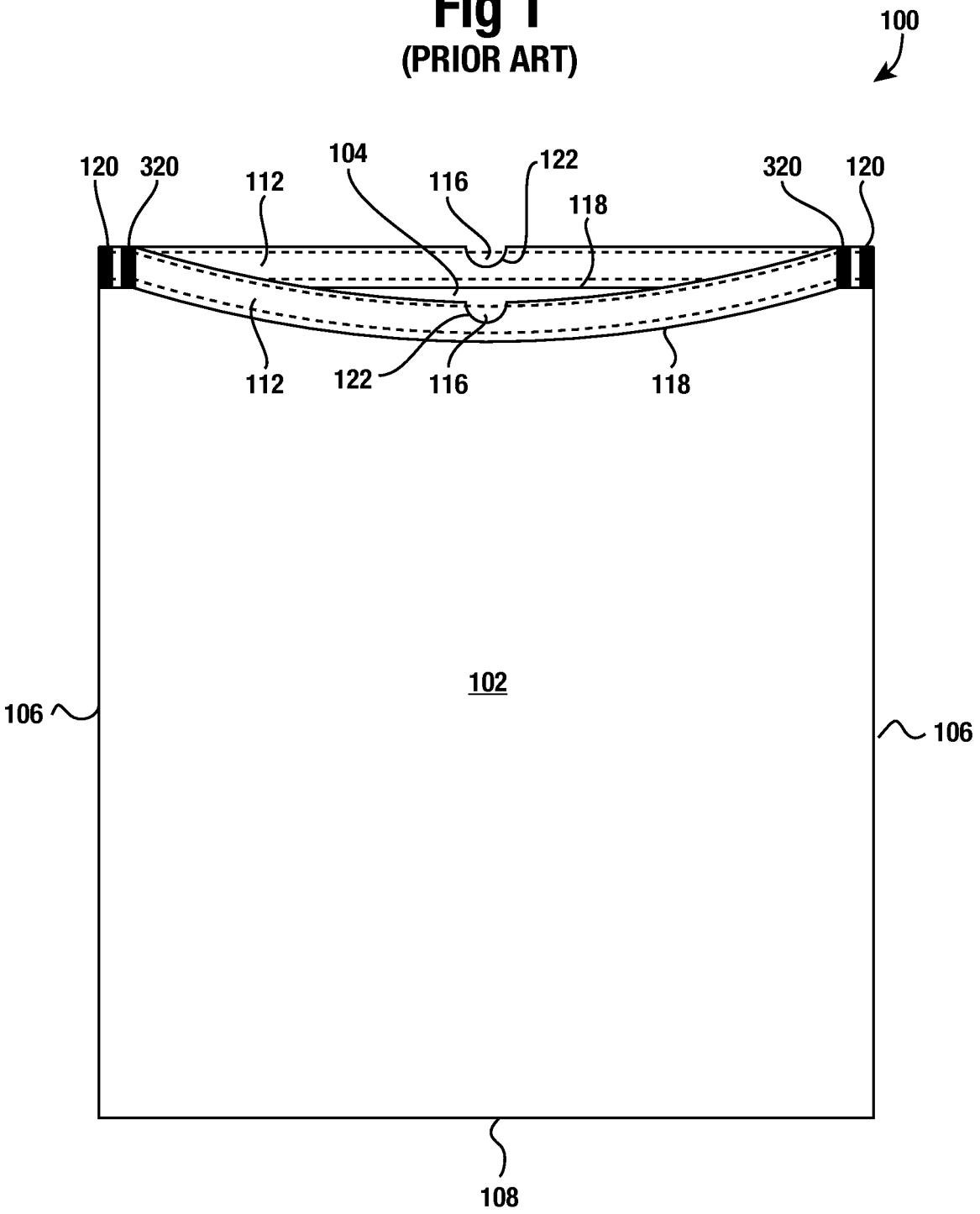
Fig 1 (PRIOR ART)

U.S. PATENT DOCUMENTS 6,635,139 B2 * 10/2003 Bohn ..... B29C 65/18 156/251
7,077,796 B2 * 7/2006 Rusnak ..... B65D 33/30 493/214
8,523,439 B2 * 9/2013 Ross ..... B65F 1/0006 383/75
8,702,308 B2 * 4/2014 Ross ..... B65D 33/28 383/75
2004/0097357 A1 * 5/2004 Pihl ..... B65D 33/28 493/190
2005/0207681 A1 * 9/2005 Raterman ..... B65F 1/0006 383/75
2007/0036472 A1 * 2/2007 Persenda ..... B65F 1/0006 383/33
2008/0137995 A1 * 6/2008 Fraser ..... B65F 1/0006 383/75
2009/0074332 A1 * 3/2009 Bonke ..... B65F 1/0006 383/33
2010/0046860 A1 * 2/2010 Kent ..... B65F 1/0006 383/75
2010/0247002 A1 * 9/2010 Ross ..... B65F 1/0006 383/75
2011/0052103 A1 * 3/2011 Hall ..... B65F 1/0006 383/75
2011/0075952 A1 * 3/2011 Mallory ..... B65F 1/0006 383/75
2011/0081103 A1 * 4/2011 Hall ..... B65D 33/28 383/75
2014/0056544 A1 * 2/2014 Moras ..... B65D 33/28 383/72
2017/0081084 A1 * 3/2017 Moody ..... B65D 33/28

* cited by examiner

DRAWSTRING TRASH BAG

CROSS-REFERENCE TO RELATED APPLICATIONS

This application is a continuation of U.S. application Ser. No. 16/269,040, filed Feb. 6, 2019, and is hereby incorporated by reference into this disclosure in its entirety.

BACKGROUND OF THE INVENTION

1. Field of the Invention

The present invention relates to improvements in the construction and manufacture of polymeric bags. In particular, the present invention relates to improvements in the construction and manufacture of drawstring-type polymeric bags, especially polymeric trash bags.

2. Description of the Related Art

Polymeric bags are ubiquitous in modern society, available in a variety of different combinations of materials, capacities, thicknesses, dimensions and colors. Such bags are used for a variety of purposes including long-term storage, food storage and trash collection. In response to consumer demand, manufacturers of polymeric bags have developed innovations over the years to improve the utility and performance of polymeric bags. The present invention is of particular interest to polymeric bags used for trash collection and the method for securely closing and carrying such bags. Furthermore, the present invention provides advantages when using such bags within trash receptacles.

The utility and desirability of polymeric trash bags is primarily driven by the convenience of securely closing and carrying a particular trash bag after filling it with debris. Over the years, several different methods have been commonly available, each method having certain advantages and disadvantages. One of the oldest methods for securing a trash bag is to provide a twist-tie to accompany the bag, allowing a consumer to bunch the upper opening of the bag together after filling. The twist-tie may be used to hold the bunched plastic together, securing the bag for disposal.

Another common configuration is the multi-flap bag, also commonly known as a wave-cut bag, where the top edges of the bag are cut in a wave-like pattern to provide two or more flaps extending upward from the top of the bag. These flaps allow the user to tie the opposing flaps together, securing the contents of the bag inside while also providing a convenient handle for carrying the filled bag.

As the name suggests, drawstring bags utilize drawstrings, also known as draw tapes, which are incorporated into the bag design. In particular, a pair of drawstrings may be enclosed within two hems running along the top edges of the panels forming the trash bag. In the drawstring trash bags known in the prior art, a pair of short seals, located near the upper corners of the bag, are formed by applying heat and pressure to weld the drawstrings and the panels of the bag together.

After the bag is filled with trash, the drawstrings can be pulled through a pair of cutouts centrally located in the hems between the opposing sides of the bag. These drawstrings can be tied together to close the bag and provide a handle for carrying the filled bag. Despite the increased complexity of drawstring trash bags, the growing demand for drawstring trash bags provides the impetus for improvements for such bags, including the improvements disclosed herein.

Many consumers find that typical drawstring bags are difficult to secure over the upper lip of a trash receptacle. Therefore, it would be desirable to offer a drawstring trash bag that makes it easier to place the top of the drawstring bag over a trash receptacle. While the fit of a conventional drawstring trash bag over the upper lip of the receptacle may be sufficient in some cases to keep the drawstring bag secured onto the trash receptacle, the drawstring bag may still have a tendency to fall into the receptacle as the bag is filled. In fact, it is not uncommon for the weight of the trash in the bag to pull the upper opening of the bag down into the trash receptacle. Without some mechanism to provide a drawstring that is secured over the upper lip of the trash receptacle, the drawstring bag may have a tendency to fall into the receptacle as garbage is thrown into the bag. Therefore, it would also be desirable to provide a drawstring that assists in securing the drawstring bag over the upper lip of a trash receptacle.

In the prior art, it was disclosed to utilize elastic materials as a component of the drawstring for a trash bag to provide a way to secure the upper part of the bag over the upper lip of a trash receptacle. In particular, prior art applications of elastic drawstrings are disclosed which provide a pair of large notches at the upper corners of the bag used to pull the elastic drawstring outward from the sides of the bag. In such a prior art embodiment, two elastic drawstring pieces are disposed within the hems which run the width of the upper edges of the trash bag. The two pieces of elastic drawstring are joined together at the respective ends of each drawstring to provide a continuous loop. Because of the elasticity of the drawstring, the continuous loop can be extended and fitted over the upper lip of a trash receptacle holding the bag in place. While this method may be effective in certain instances, it differs significantly from the typical configuration of a drawstring trash bag where the drawstring is pulled through the centrally located access cutouts along the upper edges of the bag. The awkward configuration of the prior art bag therefore detracts from its desirability.

The prior art elastic drawstring bag discussed above has disadvantages that make it less desirable in other respects as well. For example, the notches cut out of the top corners of the bag inherently result in substantial holes in the drawstring bag when closed for disposal. To better illustrate this point, the prior art bag can be compared to a traditional drawstring trash bag, the latter of which is closed by pulling the drawstrings through centrally located access cutouts. When the drawstrings are pulled through the centrally located access cutouts, the upper opening is reduced to a very small opening at the top of the bag. The small size of this single opening prevents smaller debris from falling out of the bag. Also, when the opposing drawstrings are tied together in a traditional drawstring trash bag, the drawstrings reduce the size of the hole and also cover the gap. In contrast, in the prior art elastic drawstring bags, the notches cut out of the upper corners of the bag result in substantial holes at the top sides of the bag when the drawstrings are pulled closed, which can result in permitting debris and trash to fall out. Furthermore, unlike the traditional drawstring trash bags, when the prior art elastic drawstring bag is tied, the tied drawstrings do not cover the substantial holes formed by the notches.

The prior art discloses further improvements to elastic drawstring trash bags. For instance, U.S. Pat. No. 8,702,308, entitled Reduced Opening Elastic Drawstring Bag issued to Ross, discloses a reduced opening of the bag by decreasing the opening between the openings of the short seals that weld the two opposing ends of the drawstring to the hems of the bag. The opening is reduced by each short seal having an exaggerated width. Furthermore, U.S. Pat. No. 8,523,439, entitled Elastic Drawstring Trash Bag, also to Ross, discloses another means of reducing the opening of the trash bag by utilizing a pair of short seals, an inner and an outer seal, at each opposing end of the bag's hem.

In view of the foregoing, it would be desirable to offer further improvements to elastic drawstring bags discussed above. It would be desirable for improvements that decrease the surface area of the short seals while maintaining consistent pressure on the area that is being sealed. This disclosure addresses these objectives.

SUMMARY OF THE INVENTION

The present invention is directed toward an improved construction of a drawstring trash bag. Specifically, the present invention provides a drawstring trash bag having a first panel and a second panel joined along three edges to form the bag. At a fourth upper edge of the first panel and the second panel an upper opening of the drawstring trash bag is defined. A first drawstring is provided within a first hem formed in the first panel along the upper edge of the drawstring trash bag. A first outer seal section welds together the first panel, the first drawstring, the second drawstring and the second panel. The first outer seal section is adjacent or proximate to a first upper corner of the drawstring trash bag. A first inner seal section welds together the first panel, the first drawstring, the second drawstring and the second panel. The first inner seal section is located along the upper edge of the drawstring trash bag and inwardly spaced from the first outer seal section. A first intermediate seal section connects the first outer seal section to the first inner seal section. The first intermediate and the first inner seal sections can also weld together the first panel, the first drawstring, the second drawstring, and the second panel. The first outer seal section, the first inner seal section, and the first intermediate seal section can define a single continuous sealed surface.

In certain embodiments of the present invention the first intermediate seal section can have a width extending in a vertical direction and the width of the first intermediate seal section can be less than one quarter of a height of the first drawstring. The first inner and outer seal sections can have a width extending in the horizontal direction and the width of the first inner and outer seal sections can be less than one quarter of the height of the first drawstring. The first inner and outer seal sections and the first intermediate seal section can have substantially the same width. The first inner and outer seal sections can have a major axis extending substantially perpendicular to the upper edge. A major axis of the first intermediate seal section can extend substantially parallel to the upper edge. A distance from an outer edge of the first outer seal section to an opposing outer edge of the first inner seal section can be greater than a height of the drawstring. The length of the first intermediate seal section can be greater than a summation of the widths of the first inner and outer seal sections. Furthermore, the first outer seal section, first inner seal section, and first intermediate seal section can define an H shape.

A further embodiment of the present invention can comprise a drawstring trash bag. The drawstring trash bag can further comprise a first panel and a second panel. The first panel and the second panel can be joined along opposing first and second side edges and a bottom edge. An upper edge of the first panel and the second panel can define an upper opening of the drawstring trash bag. A first drawstring can be provided within a first hem formed in the first panel along the upper edge of the drawstring trash bag. A first integrated short seal can weld together the first panel, the first drawstring, the second drawstring and the second panel. The first integrated short seal can be adjacent to a first upper corner of the drawstring trash bag. The first integrated short seal can have an inner seal section, an outer seal section, and an intermediate seal section. The inner seal section and outer seal section can have a length extending in a generally vertical direction. The intermediate seal section having a length extending in a generally horizontal direction and interconnecting the inner and outer seal sections. The outer seal section can be adjacent to the first side edge and the inner seal section can be inwardly spaced from the outer seal section.

An additional embodiment of the invention can also comprise a drawstring trash bag. A first panel and a second panel can be joined along three edges of the first panel and the second panel. A fourth upper edge of the first panel and the second panel can define an upper opening of the drawstring trash bag. A first drawstring can be provided within a first hem formed in the first panel along the fourth edge of the drawstring trash bag. A first short seal can weld together the first panel, the first drawstring, the second drawstring and the second panel, wherein the first short seal is proximate to a first upper corner of the drawstring trash bag. A first inner seal can also weld together the first panel, the first drawstring, the second drawstring and the second panel, wherein the first inner seal is along the upper edge of the drawstring trash bag and inwardly spaced from the first short seal. A first intermediate seal can connect the first short seal to the first inner seal, wherein the first short seal, the first inner seal, and the first intermediate seal define a single continuous sealing surface.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and preferred embodiment when viewed with reference to the accompanying drawings. The drawings can be briefly described as follows.

FIG. 1 provides a perspective view of a prior art drawstring trash bag.

Figure 2:
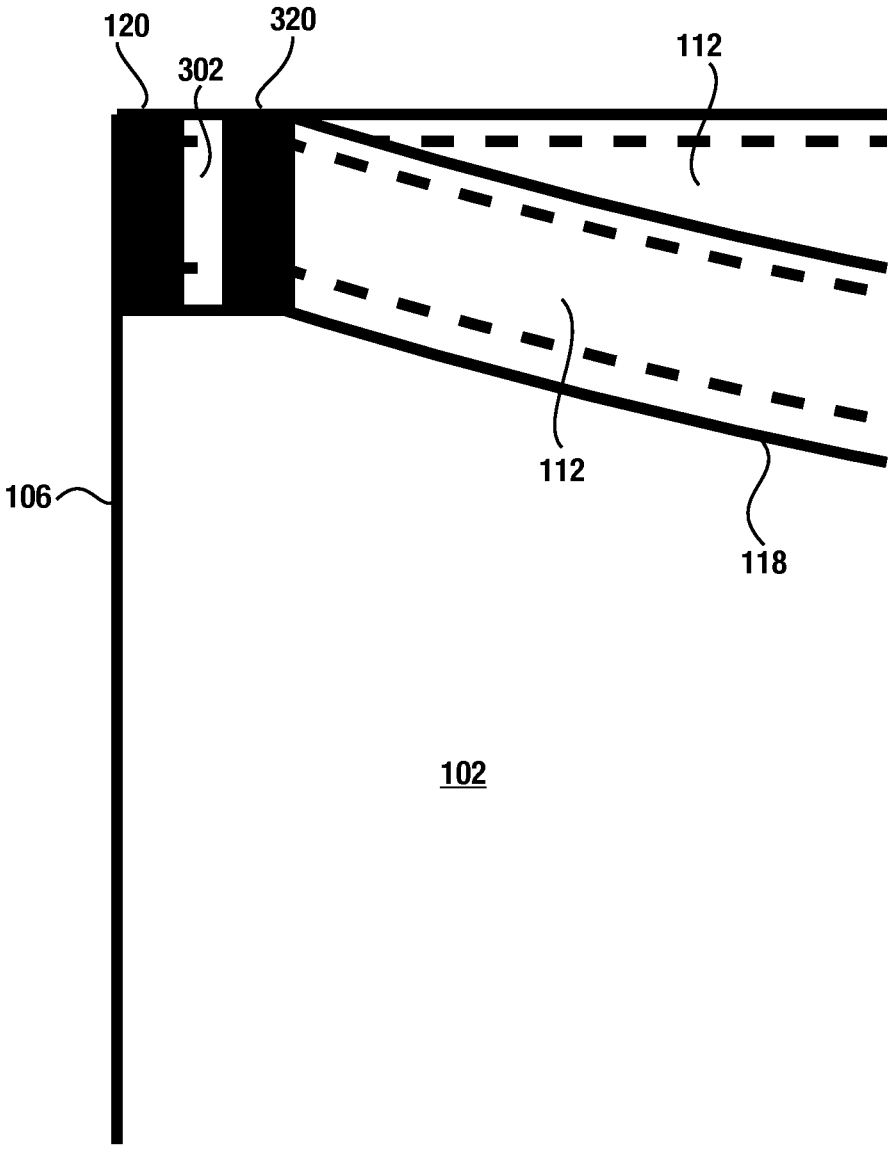
Fig 2 (PRIOR ART)

FIG. 2 provides an enlarged perspective view of an upper corner of the bag of FIG. 1.

Figure 3:
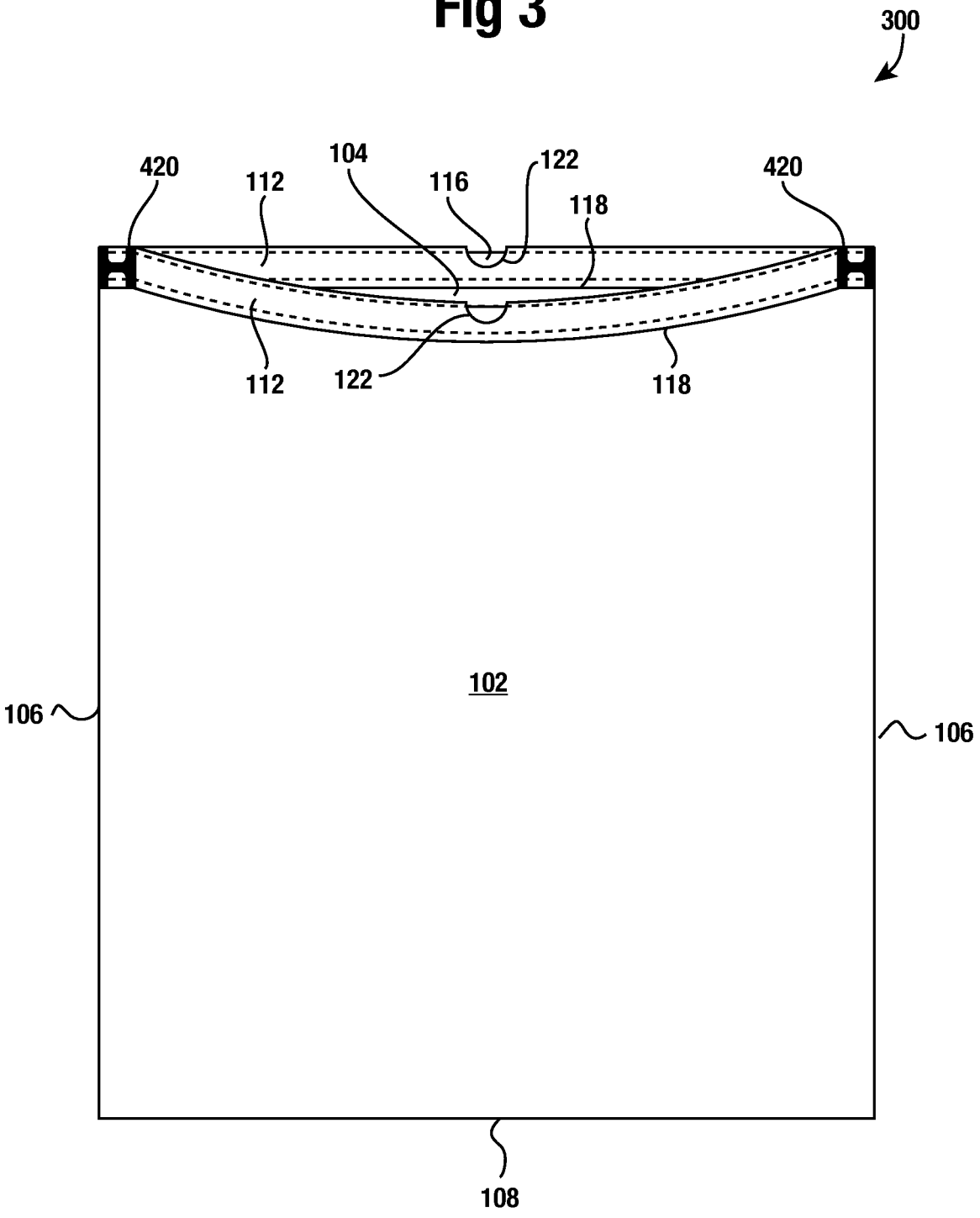

FIG. 3 provides a perspective view of an embodiment of the present invention.

Figure 4:
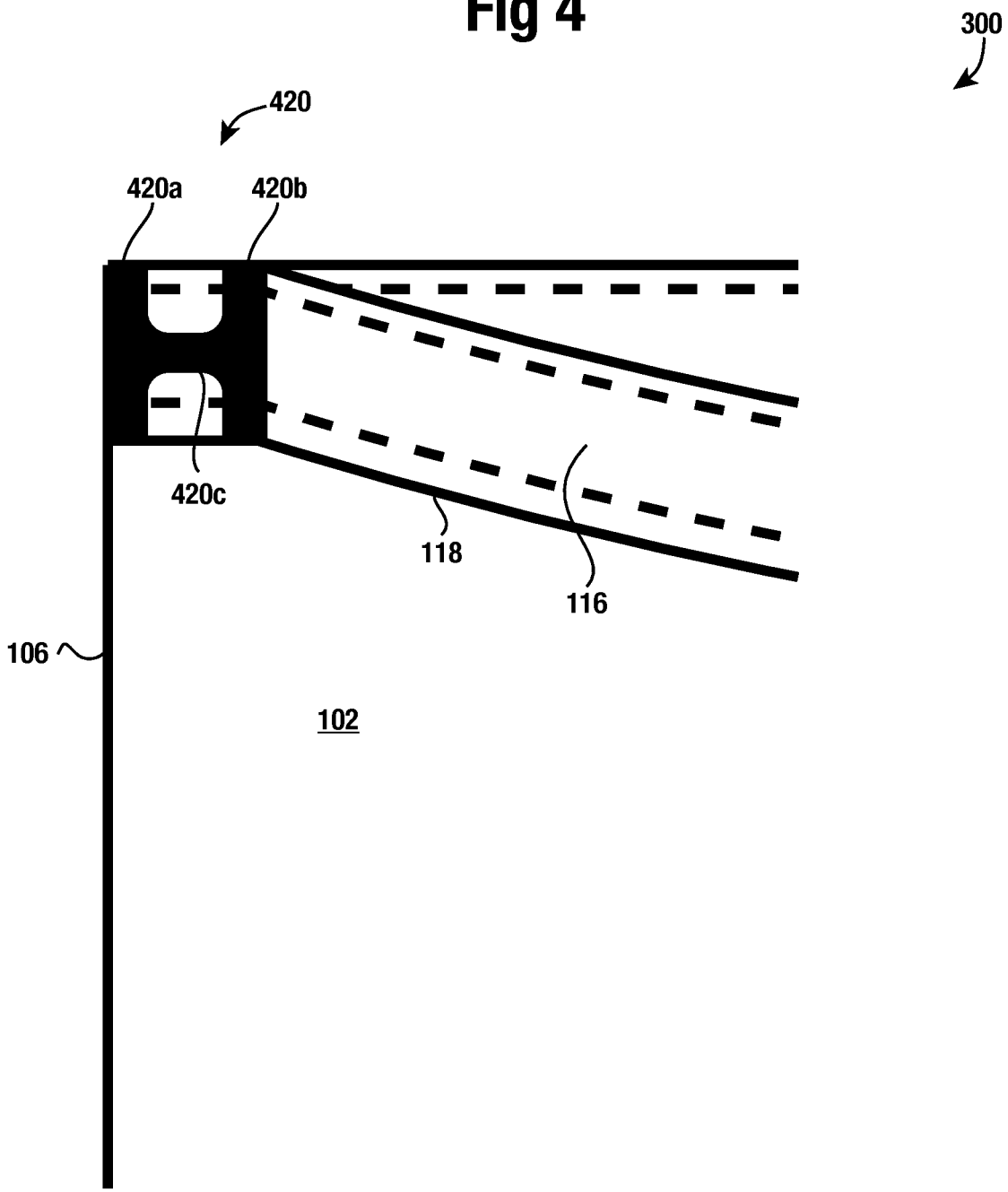

FIG. 4 provides an enlarged perspective view of the drawstring trash bag of FIG. 3.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included into the depicted embodiments without diverging from the spirit of the invention. Therefore, it is understood that the present invention is not limited to the embodiments disclosed herein. Rather, the scope of the invention shall be broadly defined by the appended claims which are intended to more fully and accurately encompass the invention to the fullest extent possible. However, it is fully appreciated that the use of certain terminology shall not be construed to conclusively limit the scope of protection if otherwise within the spirit of the present invention.

Referring initially to FIG. 1, a perspective view of a drawstring trash bag 100 of the prior art is shown. As depicted in FIG. 1, the drawstring trash bag 100 is comprised of a first panel 102 and a second panel 104 joined along three sides. In certain embodiments, bag 100 can be formed from a flattened tube and can be manufactured via a blown film extrusion process. Bottom 108 of bag 100 can be defined by a folded edge of the flattened tube and the sides 106 of bag 100 can be sealed using any one of several methods that are known in the art. The various types of construction of drawstring trash bags 100 are well known in the art and the particular method of manufacture is not intended to limit the present invention.

The drawstring trash bag 100 depicted in FIG. 1 is provided with a pair of drawstrings 116 enclosed within the hems 112 of the drawstring trash bag 100. As known in the art, the top portions of the first panel 102 and the second panel 104 are folded and sealed to form hems 112. The hem seals 118 run the width of the bag with drawstrings 116 within hems 112. A pair of centrally located drawstring cutouts 122 is provided in hems 112 for accessing drawstrings 116. A pair of short seals 120 is provided at the upper corners of the drawstring trash bag 100, sealing the first panel 102, second panel 104 and the pair of drawstrings 116 together.

The short seals 120 should be sufficiently strong to allow a consumer to pull the drawstrings 116 through the cutouts 122 and to close the upper opening of the drawstring trash bag 100. If the short seals 120 are not strong enough, the drawstrings 116 may dislodge, eliminating the benefits of the drawstring trash bag 100.

Short seals 120 are shown rectangular in shape in FIG. 1. Each short seal 120 can have a width from one-eighth to one-half of an inch for a typical 13-gallon drawstring trash bag, with such bag typically having a width of generally 24 inches and a height of generally 24 to 27 inches. The height of the hems 112 of bag 100 are shown extending from the upper opening of the bag to the bottom of the hem seal 118. Short seals 120 are shown also extending the height of the hem, from the upper opening of the bag to the hem seal 118. In certain embodiments, the short seals may not extend to the bottom of the hem but typically will extend at least to the bottom of the drawstring 116.

Further shown by FIG. 1 are inner seals 320 spaced apart from each short seal 120 and positioned along the upper hems 112 of drawstring trash bag 100. Inner seals 320 weld the first panel 102, second panel 104, and drawstrings 116 together in the same manner as short seals 120. Inner seals 320 are shown having similar shape and size to short seals 120, extending from the upper edge of the drawstring trash bag 100 to the hem seal 118 of the upper hems 112 and having a substantially rectangular shape. In certain embodiments, the inner seals 320 may not extend to the bottom of the hem but typically will extend at least to the bottom of the drawstring 116 in the same manner as short seals 120.

The inner seals 320 reduce the width of the upper opening of elastic drawstring trash bag 100. However, when a user stretches the upper opening around the upper rim of a trash receptacle, the polyethylene material used for the first panel 102 and second panel 104 stretches, allowing the elastic drawstring of trash bag 100 to be placed over the upper rim of a trash receptacle, even if the trash receptacle is larger than the upper opening of the trash bag. To allow bag 100 to stretch over the can, drawstrings 116 may include elastomeric polymers to provide desirable elastic characteristics and controlled stretching properties.

Looking now at FIG. 2, an enlarged perspective view of an upper corner of bag 100 is shown. Short seal 120 welds together the first panel 102, the second panel 104, and the drawstrings 116 contained within hems 112. As discussed above, it typically is desirable for the short seals 120 to have sufficient strength to permanently weld the front panel 102, second panel 104, and drawstrings 116 together so the drawstring does not dislodge when pulled by a user of bag 100. As shown in FIGS. 1 and 2, the short seal 120 and the inner seal 320 have an unsealed area 302 located between the two seals 120 and 320.

The inner seals 320 are shown substantially rectangular in shape. The inner seals 320 can be approximately the same size and shape as the short seals 120. The inner seals 320 may be approximately one-eighth to one-half inch when measured along the width of the bag for a typical kitchen drawstring trash bag and will typically span from the upper opening of the bag to the hem seals 118.

FIGS. 3 and 4 illustrate bag 300, an embodiment of the present invention. Rather than short seals 120 and inner seals 320 of bag 100, bag 300 utilizes integrated short seals 420. As best shown by FIG. 4, integrated short seal 420 comprises an outer seal section 420*a*, an inner seal section 420*b*, and an intermediate seal section 420*c*. In at least certain embodiments, outer, inner, and intermediate seal sections 420*a*, 420*b*, and 420*c* are interconnected with each other so as to comprise a continuous sealing surface. As shown by the figures, the three sections can be arranged to define an H-shape for integrated short seal 420. In certain embodiments, a side seal of sides 106 of bag 300 can also be interconnected with the outer, inner, and intermediate seal sections 420*a*, 420*b*, and 420*c* such that the seal sections 420*a*, 420*b*, and 420*c* and side seal form a continuous sealing surface.

As best shown by FIG. 4, the intermediate seal section 420*c* can have a length greater than its width with its length extending in a horizontal direction from an inner edge of the outer seal section 420*a* to an opposing inner edge of the inner seal section 420*b*. A length of the outer and inner seal sections 420*a* and 420*b* can extend vertically and have edges on opposing sides of each section extending parallel to the vertical direction. A major axis can be defined for the lengthwise direction of each of the seal sections 420*a*, 420*b*, and 420*c* and a minor axis can be defined extending perpendicular from the major axis for each section, extending in the widthwise direction for each section.

In certain embodiments, the length of the intermediate seal section 420*c* can exceed the summation of the widths of outer and inner seal sections while in other embodiments the two measurements can generally be equal. In further embodiments, the length of the intermediate seal section 420*c* can be less than the summation of the outer and inner seal section widths. Furthermore, the length of each section, in certain embodiments, can be at least twice the width of the corresponding width of a section.

FIG. 4 further shows that at each intersection of the intermediate section 420*c* with the outer and inner seal section 420*a* and 420*b* can have a radius or rounded corners. The intersections can have rounded corners along both upper and lower horizontal edges of the intermediate seal section as further shown in FIG. 4. These rounded corners can help reduce stress concentrations in the seal when it is placed under stress by pulling of drawstring 116.

For bag 300 having dimensions of a typical kitchen drawstring trash bag with a one-inch high drawstring, the width of each section 420*a*, 420*b*, and 420*c* may be about ⅛ inch but may also range in width between 1/16 and ½ of an inch. For a typical one-inch wide drawstring, the width of each section would be about ⅛ of the drawstring's width. In certain embodiments, the overall width of integrated short seal 420 can extend from an outer edge of outer section 420*a* to an outer edge of inner section 420*b* and can be about equal to or exceed the height of drawstring 116. In further embodiments, the overall width of seal 420 can be less than the height of drawstring 116.

Use of integrated short seals 420 provide certain advantages not realized in the prior art. For instance, intermediate seal section 420*a* and 420*b* interconnecting the outer and inner sections 420*a* and 420*b* allows for consistent pressure and therefore more consistent seals to be formed from inner and outer seal sections 420*a* and 420*b* in comparison to the separated short seal and inner seal of prior art bag 100. The interconnection between the inner and outer seal sections 420*a* and 420*b* by intermediate seal section 420*a* and 420*b* can also provide for better heat distribution when the seal is formed and thus provide for more consistency between the inner and outer seal sections in comparison to the short seal and inner seal of prior art bag 100.

As discussed in the Background of the Invention, it is also known to have a single wide short seal in lieu of short seal 120 and inner seal 320. Unlike a single wide short seal, the integrated seal 420 provides for less area to be sealed and thus is less likely to have air trapped within the seal. Furthermore, with less surface area to heat, integrated short seals 420 allows for better control of sealing heat and temperature along the sealing surface during the manufacturing process to provide for a stronger seal between the drawstring, hems, and panels of bag 300.

The integrated seal 420 welds the first panel 102, the second panel 104, and the drawstrings 116 together much like the short seal 120 at the corners of the improved elastic drawstring bag 300. In certain embodiments, it is contemplated that the integrated seals 420 extend from the upper edge of the drawstring trash bag 300 to the hem seal 118 of the upper hems 112.

The integrated seals 420 function to reduce the width of the upper opening of the improved elastic drawstring trash bag 300. When an individual stretches the upper opening around the upper rim of a trash receptacle, the polyethylene material used for the first panel 102 and second panel 104 stretches, allowing the improved elastic drawstring trash bag 300 to be placed over the upper rim of a trash receptacle, even if the trash receptacle is larger than the upper opening of the improved elastic drawstring trash bag 300.

Elastomeric polymers included in the drawstrings 116 of bag 300 are specifically intended to allow a limited amount of stretching. The limited stretching allows bag 300 to fit over the rim of a trash receptacle, even if the circumference of the rim is larger than the reduced width (resulting from, in particular, inner seal section 420*b*). More importantly, after bag 300 is stretched over the rim of a trash receptacle, the elastomeric polymers in the drawstrings 116 cause the drawstrings 116 to contract to their original length, providing a tight fit of the drawstrings around the outside of the trash receptacle.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

I claim:

1. A drawstring trash bag comprising:

a first panel and a second panel, the first panel and the second panel joined along three edges of the first panel and the second panel, a fourth edge of the first and second panels defining an upper opening of the drawstring trash bag, a first drawstring provided within a first hem formed in the first panel along the fourth edge of the drawstring trash bag, a first outer seal section welding together the first panel, the first drawstring, the second drawstring and the second panel, wherein the first outer seal section is adj acent to a first upper corner of the drawstring trash bag, a first inner seal section welding together the first panel, the first drawstring, the second drawstring and the second panel, wherein the first inner seal section is adjacent to the fourth edge of the drawstring trash bag and inwardly spaced from the first outer seal section, a first intermediate seal section connecting the first outer seal section to the first inner seal section, wherein the first outer seal section, the first inner seal section, and the intermediate seal section define a single continuous sealed surface, the first intermediate seal section having a width extending in a vertical direction, and the first inner and outer seal sections having a height extending in the vertical direction, the height of the first inner and outer seal sections greater than the width of the first intermediate seal section.

2. The drawstring trash bag of claim 1 further comprising:

the width of the first intermediate seal section less than one quarter of a height of the first drawstring, and the first inner and outer seal sections having a width extending in the horizontal direction, the width of the first inner and outer seal sections less than one quarter of the height of the first drawstring.

3. The drawstring trash bag of claim 2 further comprising:

the first inner and outer seal sections and the first intermediate seal section having substantially the same width.

4. The drawstring trash bag of claim 3 further comprising:

the first inner and outer seal sections having a major axis extending substantially perpendicular to the fourth edge, and a major axis of the first intermediate seal section extending substantially parallel to the fourth edge.

5. The drawstring trash bag of claim 1 further comprising:

the first intermediate seal section welding together the first panel, the first drawstring, the second drawstring and the second panel.

6. The drawstring trash bag of claim 1 further comprising:

a distance from an outer edge of the first outer seal section to an opposing outer edge of the first inner seal section greater than a height of the first drawstring.

7. The drawstring trash bag of claim 6 further comprising:

the length of the first intermediate seal section greater than a summation of the widths of the first inner and outer seal sections.

8. The drawstring bag of claim 1, further comprising:

the first outer seal section, first inner seal section, and first intermediate seal section defining an H shape.

9. A drawstring trash bag comprising:

a first panel and a second panel, the first and second panels joined along three edges, a fourth edge of the first panel and the second panel defining an upper opening of the drawstring trash bag, a first drawstring provided within a first hem formed in the first panel along the fourth edge, the first drawstring having a height extending in the vertical direction, a first short seal welding together the first panel, the first drawstring, the second drawstring and the second panel, wherein the first short seal is proximate to a first upper corner of the drawstring trash bag, a first inner seal welding together the first panel, the first drawstring, the second drawstring and the second panel, wherein the first inner seal is along the fourth edge and inwardly spaced from the first short seal, and a first intermediate seal welding together the first panel, the first drawstring, the second drawstring and the second panel, the first intermediate seal connecting the first short seal to the first inner seal, wherein the first short seal, the first inner seal, and the first intermediate seal define a single continuous sealing surface, and the first intermediate seal having a width extending in a vertical direction, the width of the first intermediate seal less than the height of the first drawstring.

10. The drawstring trash bag of claim 9 further comprising:

the first short and inner seals extending from the fourth edge of the first panel to the first hem seal.

11. The drawstring trash bag of claim 10 further comprising:

the first short seal, the first inner seal and the first intermediate seal having substantially the same width.

12. The drawstring trash bag of claim 11 further comprising:

a distance from an outer edge of the first short seal to an opposing outer edge of the first inner seal greater than a height of the drawstring.

13. The drawstring bag of claim 9, further comprising:

the first short seal, the first inner seal, and the first intermediate seal defining an H shape.

14. The drawstring trash bag of claim 13 further comprising:

the first short and inner seals having a major axis extending substantially perpendicular to the fourth edge, and the first intermediate seal having a major axis extending substantially parallel to the fourth edge.

* * * * *